US011591203B2

(12) United States Patent
Taylor et al.

(10) Patent No.: US 11,591,203 B2
(45) Date of Patent: Feb. 28, 2023

(54) WINE DISPENSER

(71) Applicant: Chagrinovations, LLC, Naples, FL (US)

(72) Inventors: Curtis Taylor, Chagrin Falls, OH (US); Matthew Hanson, Chagrin Falls, OH (US)

(73) Assignee: CHAGRINOVATIONS, LLC, Naples, FL (US)

( * ) Notice: Subject to any disclaimer, the term of this patent is extended or adjusted under 35 U.S.C. 154(b) by 0 days.

(21) Appl. No.: 17/564,530

(22) Filed: Dec. 29, 2021

(65) Prior Publication Data

US 2022/0119240 A1 Apr. 21, 2022

Related U.S. Application Data

(63) Continuation of application No. 16/774,329, filed on Jan. 28, 2020, now Pat. No. 11,286,146.

(60) Provisional application No. 62/800,017, filed on Feb. 1, 2019.

(51) Int. Cl.

| | |
|---|---|
| ***B67D 1/04*** | (2006.01) |
| ***B67D 1/08*** | (2006.01) |
| ***B67D 1/00*** | (2006.01) |
| *B01F 101/17* | (2022.01) |

(52) U.S. Cl.

CPC ..... *B67D 1/0431* (2013.01); *B67D 1/0004* (2013.01); *B67D 1/0888* (2013.01); *B01F 2101/17* (2022.01); *B67D 2001/0097* (2013.01); *B67D 2001/0493* (2013.01)

(58) Field of Classification Search

CPC .. B67D 1/0431; B67D 1/0004; B67D 1/0888; B67D 2001/0097; B67D 2001/0493; B67D 2001/0098; B67D 2001/0824; B01F 2101/17

See application file for complete search history.

(56) References Cited

U.S. PATENT DOCUMENTS

| | | | | |
|---|---|---|---|---|
| 8,561,970 | B1 * | 10/2013 | Mills | B01F 23/23121 99/323.1 |
| 9,630,153 | B2 * | 4/2017 | Lincoln | B01F 23/23123 |
| 9,862,590 | B2 | 1/2018 | Chung | |
| 11,000,813 | B2 | 5/2021 | Giardullo | |
| 2013/0201782 | A1 * | 8/2013 | Ruff | A47G 19/12 215/386 |
| 2014/0242241 | A1 | 8/2014 | Chen et al. | |
| 2015/0367295 | A1 | 12/2015 | Okumura et al. | |
| 2016/0325243 | A1 * | 11/2016 | McDonald | B67D 1/10 |
| 2018/0072553 | A1 | 3/2018 | Lyons et al. | |

(Continued)

FOREIGN PATENT DOCUMENTS

| | | | | |
|---|---|---|---|---|
| EP | 2030943 | A1 * | 3/2009 | B05B 9/0805 |

*Primary Examiner* — Donnell A Long

(74) *Attorney, Agent, or Firm* — Ulmer & Berne LLP; Brian E. Turong

(57) ABSTRACT

A liquid dispenser adapted to dispense liquid from a beverage container. The liquid dispenser includes a top portion and a bottom portion. The liquid dispenser includes an electric powered pump that is configured to cause fluid to flow into the bottom portion when the electric powered pump is activated. The bottom portion is fluidly connected or interconnected to the top portion such that fluid which flows into the bottom portion is configured to flow out of the bottom portion and to the top portion.

22 Claims, 7 Drawing Sheets

(56) References Cited

U.S. PATENT DOCUMENTS

| | | | | |
|---|---|---|---|---|
| 2018/0290873 | A1* | 10/2018 | Zhu | B67D 1/0431 |
| 2018/0303116 | A1 | 10/2018 | Rubin et al. | |
| 2018/0312386 | A1 | 11/2018 | Brun-Kestler et al. | |
| 2021/0219783 | A1* | 7/2021 | Liu | A47J 43/00 |

* cited by examiner

WINE DISPENSER

The present disclosure is a continuation of U.S. application Ser. No. 16/774,329 filed Jan. 28, 2020, which in turn claims priority on U.S. Provisional Application Ser. No. 62/800,017 filed Feb. 1, 2019, which are both incorporated herein by reference.

The present disclosure is directed to a liquid dispenser, and more particularly to a beverage pump, and more particularly to a wine pump that can be used to dispense and optionally aerate wine from a wine bottle. As can be appreciated, the liquid dispenser can be used on or with other types of containers to dispense other types of fluids.

BACKGROUND OF THE INVENTION

Wine consumption in the world is ever increasing. As any wine enthusiast is aware, most wines, especially red wines, need to breathe before the wine achieves its best taste. As such, the bottle of wine typically needs to be opened and allowed to breathe for several minutes before being poured into a glass and consumed. When wine is being served at an event or party, allowing the wine to breathe for several minutes is unacceptable. Also, for many individuals, once the wine bottle is opened, the individual wants to immediately consume the wine.

Several types of wine aerators have been created to speed up the wine breathing process. This wine aerators typically require the wine to be poured from a bottle into a device that causes the wine to swirl in the device to reduce the time that the air mixes with the wine. These devices significantly reduce the breathing time for the wine; however, the use of these devices can be inconvenient and messy. The user typically must carefully pour the wine into the device to avoid spillage, and then transfer the wine into a wine glass. Other devices allow the user to hold the device over a wine glass and then carefully pour the wine from the wine bottle into the device wherein the wine is deposited into the wine glass. Once again, when wine is being served at an event or party, the time needed to use the wine aerator is unacceptably time consuming and can result in significant wine spillage. For some individuals, it is too complex or difficult to pour the wine into these wine aerator devices.

A few wine aerators are designed to be fitted onto the top of the wine bottle. The non-electric versions of these types of wine aerators require the user to place the device on the wine bottle and then pour the wine out of the wine bottle and through the wine aerator. Although this type of wine aerator is more convenient to use, significant spillage and wine glass breakage can occur if the wine aerator falls off the end of the wine bottle during the pouring of the wine into a wine glass. The electric versions of wine aerators that fit on the top of the wine bottle typically do not require the wine bottle to be tilted to dispense the wine. These devices use either a liquid dispenser or air pressure to cause the wine to be dispensed from the wine bottle. However, these devices are generally bulky, and result in wine continuing to drip from the device after the air or liquid dispenser is deactivated.

In view of the current state of wine aerators, there is a need for a wine aerator that is easy to use, can be releasably connected to the top of a wine bottle, has a reduced profile to reduce the bulkiness of the wine aerator, and which reduces incidences of wine spillage during and after use of the wine aerator.

SUMMARY OF THE DISCLOSURE

The present disclosure is directed to a liquid dispenser that is designed to dispense beverages such as wine.

In one non-limiting aspect of the present disclosure, the liquid dispenser of the present disclosure can be directed to a pump system that can be easily and conveniently used by consumers to dispense beverages from containers. The liquid dispenser as described in the present disclosure enables a user to create a fountain-type dispenser so as to enable convenient dispensing of fluid from a container without having to lift and then pour a liquid from the container.

In another and/or alterative non-limiting aspect of the present disclosure, there is provided a liquid dispenser that includes a top portion and a bottom portion. The material and/or colors of the components of the liquid dispenser are non-limiting. Generally, the materials are durable, water resistant, and lightweight. Non-limiting materials that can be used include plastic, rubber, metal, resinous material, composite material, etc. The size and shape of the top portion and the bottom portion are non-limiting.

In still another and/or alternative non-limiting aspect of the present disclosure, the profile of the top portion is generally selected to be a low profile; however, this is not required. The low profile of the top portion (when used) enables the liquid dispenser to connect to the top of a container and still enables the liquid dispenser positioned on a container to be placed on a storage shelf (e.g., refrigerator shelf, refrigerator door shelf, etc.); however, this is not required.

In yet another and/or alternative non-limiting aspect of the present disclosure, the top portion of the liquid dispenser includes a dispenser activator such as, but not limited to, dispensing tab, knob, and/or button. In one non-limiting embodiment of the invention, a button is positioned on the top surface of the top portion to enable a user to simply depress/undepress the button to activate/deactivate the liquid dispenser. As can be appreciated, the button can be located on other locations of the top portion of the liquid dispenser. The dispenser activator can include a biasing arrangement (e.g., spring, flexible material, etc.) to bias the position of the dispenser activator in the non-activation position; however, this is not required. The size and shape of the dispenser activator are non-limiting.

In still another and/or alternative non-limiting aspect of the present disclosure, the top portion of the liquid dispenser can optionally include one or more visual indicators used to inform a user 1) when the liquid dispenser is activated and/or deactivated, 2) battery power level, 3) pump malfunction, and/or 4) liquid level in the container. The visual indicator (when used) can be printed material (e.g., on, off, etc.), a light (e.g., green light indicates on, red light indicates off, LED display, LCD display, etc.), and/or a tactile indicator (e.g., raised ribs, etc.). The one or more visual indicators can be located on any portion of the body of the top portion.

In another and/or alternative non-limiting aspect of the present disclosure, the top portion of the liquid dispenser can include one or more power sources. The one or more power sources generally include one or more batteries and/or solar cells. In one non-limiting design, one or more batteries are fully or partially positioned in the body of the top portion. In such a design, the top portion can optionally include a movable and/or removable battery cover on the body to enable a user to access the battery cavity in the body of the top portion so that the user can insert/remove one or more batteries from the battery cavity. The movable and/or removable battery cover (when used) can be positioned on the top, bottom, and/or sides of the body of the top portion. As can also be appreciated, the orientation of the one or more batteries in the battery cavity is non-limiting. As can also be appreciated, the type of battery is non-limiting (e.g., AA, AAA, 9V, watch battery, calculator battery, etc.). One or more surfaces of the battery cover can optionally include one or more ribs or other type of gripping structure to facilitate in the moving of the battery cover on the body so that a user can access the battery cavity; however, this is not required. A locking arrangement can optionally be used in association with the battery cover to lock/unlock the battery cover to the body of the top portion; however, this is not required.

In still another and/or alternative non-limiting aspect of the present disclosure, the liquid dispenser can optionally include a connector adaptor. The connector adaptor (when used) is designed to maintain the top portion of the liquid dispenser on the fluid container (e.g., wine bottle, etc.). The connector adaptor can be designed to form a liquid seal, and optionally a gas seal, between the top opening of the container and a portion of the top portion of the liquid dispenser; however, this is not required. The color, shape, and materials of the connector adaptor are non-limiting. The connector adaptor can be designed to be snapped onto the top portion of the container opening, screw-threaded onto the top portion of the container opening, wedged into top opening of the container, clamped onto the top portion of the container opening, connected to a cork that is positioned in the top opening of the container (e.g., wine bottle cork), etc.

In yet another and/or alternative non-limiting aspect of the present disclosure, the liquid dispenser includes a bottom portion that is designed to be inserted through an opening in a container and be partially or fully submerged in a liquid in the container. The bottom portion shape, size, and materials are non-limiting. Generally, the bottom portion is formed of a lightweight, durable water-resistant material (e.g., plastic, rubber, composite material, metal, etc.). The bottom portion is designed to be positioned at the bottom of the container or close to the bottom of the container when the liquid dispenser is connected to the container. In one non-limiting embodiment, the bottom of the bottom portion has a length such that when the liquid dispenser is connected to the top of a standard 750 ml wine bottle (3-3.5 in. in diameter and 12-12.5 in. tall), the bottom of the bottom portion is positioned within 1 in. of the bottom surface of the interior of the wine bottle, and typically within 0-0.5 in. of the bottom surface of the interior of the wine bottle. In another non-limiting embodiment, all or a portion of the bottom portion can be formed of a flexible material such that when the liquid dispenser is connected to the top of a standard 750 ml wine bottle, the bottom portion can slightly flex when required if the bottom of the bottom portion contacts the bottom surface of the interior of the wine bottle prior to the wine dispenser being fully inserted onto the wine bottle, thereby allowing the wine dispenser to be fully inserted onto the wine bottle. In another non-limiting embodiment, the bottom portion has a longitudinal length of at least about 0.25 in. and generally no more than about 30 in. The cross-sectional size and shape of the bottom portion are also non-limiting; however, the size and shape should be selected so that the bottom portion can be inserted into a container opening with which the liquid dispenser is to be used. In another and/or alternative non-limiting embodiment, the bottom portion has a generally circular cross-sectional shape and has a maximum diameter of about 0.1-3 in. In yet another and/or alternative non-limiting one embodiment, the bottom portion has one or more openings designed to enable fluid in a container to be drawn to the interior of the bottom portion. The location, shape, and size of the one or more openings on the bottom portion are non-limiting. In one non-limiting design, the bottom portion includes at least one opening at the bottom end of the bottom portion. The one or more openings can be circular; however, it can be appreciated that the one or more openings can have cross-sectional shapes other than a circular shape.

In yet another and/or alternative non-limiting aspect of the present disclosure, the liquid dispenser includes one or more electric powered pumps. The one or more electric powered pumps are designed to cause fluid to travel up through the bottom portion and cause the fluid to flow to the top portion and out of the dispenser head on the top portion. In one non-limiting embodiment of the invention, the one or more electric powered pumps can be partially or fully located in the top portion. In another and/or alternative non-limiting embodiment of the invention, the one or more electric powered pumps are generally sealed from the fluid that enters the liquid dispenser; however, this is not required. The sealing of the one or more electric powered pumps has one or more advantages, namely 1) the electric powered pump is not damaged by the fluid, and 2) the fluid is not contaminated by the electric powered pump. In one non-limiting design, one or more chambers located in the top portion are designed to fully or partially contain the one or more electric powered pumps and to fully or partially isolate the one or more electric powered pumps from liquid flowing through the liquid dispenser.

In still yet another and/or alternative non-limiting aspect of the present disclosure, the bottom portion is connected to the top portion. The bottom portion can be partially or fully formed of a flexible material (e.g., plastic, rubber, etc.); however, this is not required. The bottom portion can be designed to be permanently or detachably connected to the top portion of the liquid dispenser.

In another and/or alternative non-limiting aspect of the present disclosure, the liquid dispenser includes an anti-drip arrangement that reduces or prevent dripping of liquid form the dispenser after the motor to the dispenser has been deactivated. In one non-limiting embodiment, when the motor is activated by a user, an air passage that existed between the interior of the container and the top portion of the liquid dispenser is closed to prevent air from passing through the air passage. When the motor is operating, the motor causes air to flow into the interior of the container to pressurize the interior of the container. During pressurization of the container interior, liquid in the container interior is caused to be flow through one or more openings in the bottom portion of the liquid dispenser, travel upwardly through one or more interior passageways in the bottom portion, and then to the top portion of the dispenser to thereafter be dispensed from the top portion of the dispenser. When the motor is deactivated, the air passage is opened and the elevated pressure inside the interior of the container is allowed to equalize with the surrounding atmospheric pressure (e.g., 1 atm., etc.) by air flowing from the interior of the container, through the air passage in the top portion of the dispenser and then out into the surrounding environment. The rapid depressurization of the interior of the container causes fluid in the bottom portion of the dispenser to be partially or fully drawn out of the bottom portion through the one or more openings in the bottom portion of the dispenser. Due to this removal of fluid from the bottom portion of the dispenser during the depressurization of the interior of the container, there is little or no liquid present in the dispensing tip and upper portion of the bottom portion of the liquid dispenser, thereby resulting in no dripping or reduced dripping of liquid from the liquid dispenser after the motor has been deactivated. Such an arrangement is a significant advantage over prior art liquid dispensers that tend to drip after operation of the dispenser.

In another and/or alternative non-limiting aspect of the present disclosure, the liquid dispenser is configured to facilitate in the aeration of a liquid (e.g., wine, etc.) from a container as the liquid is dispensed from the liquid dispenser.

One non-limiting object of the present disclosure is the provision of a liquid dispenser that can be used to enable convenient dispensing of fluid from containers without having to lift and then pour a liquid from the container.

Another and/or alternative non-limiting object of the present disclosure is the provision of a liquid dispenser that can convert a container into a fountain-type drink dispenser.

Another and/or alternative non-limiting object of the present disclosure is the provision of a liquid dispenser that can aerate fluids.

Another and/or alternative non-limiting object of the present disclosure is the provision of a liquid dispenser that can reduce dripping from the liquid dispenser after the operation of the liquid dispenser.

Another and/or alternative non-limiting object of the present disclosure is the provision of a liquid dispenser that is adapted to dispense liquid from a beverage container, said liquid dispenser includes a top portion and a bottom portion, an electric powered air pump and a power supply are configured to power said electric powered pump; said electric powered air pump is configured to cause fluid to flow into said bottom portion and then into said top portion when said electric powered air pump is activated, said bottom portion is fluidly connected or interconnected to said top portion, said top portion includes a dispenser activator system and a dispensing portion, said dispenser activator system is configured to activate said electric powered air pump, said dispenser portion is configured to enable fluid that flows to said top portion to exit said top portion through said dispenser portion, said dispenser activator system is configured to inhibit pressurized air in a container to which the liquid dispenser is connected to exit said top portion while said electric powered air pump is activated and to allow pressurized air in the container to which the liquid dispenser is connected to exit said top portion when said electric powered air pump is deactivated.

Another and/or alternative non-limiting object of the present disclosure is the provision of a liquid dispenser wherein said top portion fully contains said electric powered pump, said power supply, and said dispenser activator system.

Another and/or alternative non-limiting object of the present disclosure is the provision of a liquid dispenser wherein said dispenser activator system includes an activation button that is biased in a position that causes said electric powered air pump to be deactivated, said activation button is movable between a position that causes said electric powered air pump to be deactivated and a position that causes said electric powered air pump to be activated, said activation button includes a sealing structure that is configured to engage an air passageway in said top portion of said liquid dispenser when said activation button moves to said position that causes said electric powered air pump to be activated, said sealing structure is configured to disengage from said air passageway in said top portion of said liquid dispenser when said activation button moves to said position that causes said electric powered air pump to be deactivated.

Another and/or alternative non-limiting object of the present disclosure is the provision of a liquid dispenser wherein said dispensing portion includes an upper and lower portion, said upper portion includes an opening that is configured to expel fluid from said liquid dispenser, said upper and lower portions each include an internal passageway, a cross-sectional shape of said internal passageway of said lower portion is different from at least a portion of a cross-sectional shape of said upper portion, said cross-sectional shape of said internal passageway of said lower portion is different from a cross-sectional shape of said opening in said upper portion.

Another and/or alternative non-limiting object of the present disclosure is the provision of a liquid dispenser wherein said cross-sectional shape of said internal passageway of said lower portion is circular and said cross-sectional shape of said opening in said upper portion is selected form the group of elongated oval shape, discorectangle shape, or obround shape.

Another and/or alternative non-limiting object of the present disclosure is the provision of a method for converting a container into a container having an electric dispenser comprising (a) providing a liquid dispenser adapted to dispense liquid from the container, said liquid dispenser including a top portion and a bottom portion, an electric powered air pump, and a power supply configured to power said electric powered pump; said electric powered air pump configured to cause fluid to flow into said bottom portion and then into said top portion when said electric powered air pump is activated, said bottom portion fluidly connected or interconnected to said top portion, said top portion including a dispenser activator system and a dispensing portion, said dispenser activator system configured to activate said electric powered air pump, said dispenser portion configured to enable fluid that flows to said top portion to exit said top portion through said dispenser portion, said dispenser activator system configured to inhibit pressurized air in a container to which the liquid dispenser is connected to exit said top portion while said electric powered air pump is activated and to allow pressurized air in the container to which the liquid dispenser is connected to exit said top portion when said electric powered air pump is deactivated; (b) placing said bottom portion in the container; and, (c) actuating said dispenser activator so that power from said power supply energizes said electric powered air pump to cause pressurized air to flow into a cavity of the container to thereby cause fluid in the container to flow into said bottom portion through one or more openings in said bottom portion, to said top portion, and out through said dispensing portion.

Another and/or alternative non-limiting object of the present disclosure is the provision of the further step of preventing fluid to drip from said dispensing portion after said electric powered air pump has been deactivated by causing fluid to be drawn at least partially back through said dispensing portion by rapid depressurization of the cavity of the container.

These and other objects and advantages will become apparent from the following description taken together with the accompanying drawings.

BRIEF DESCRIPTION OF THE DRAWINGS

Reference may now be made to the drawings, which illustrate several non-limiting embodiments that the invention may take in physical form and in certain parts and arrangements of parts wherein.

DETAILED DESCRIPTION OF NON-LIMITING EMBODIMENTS

Figure 1:
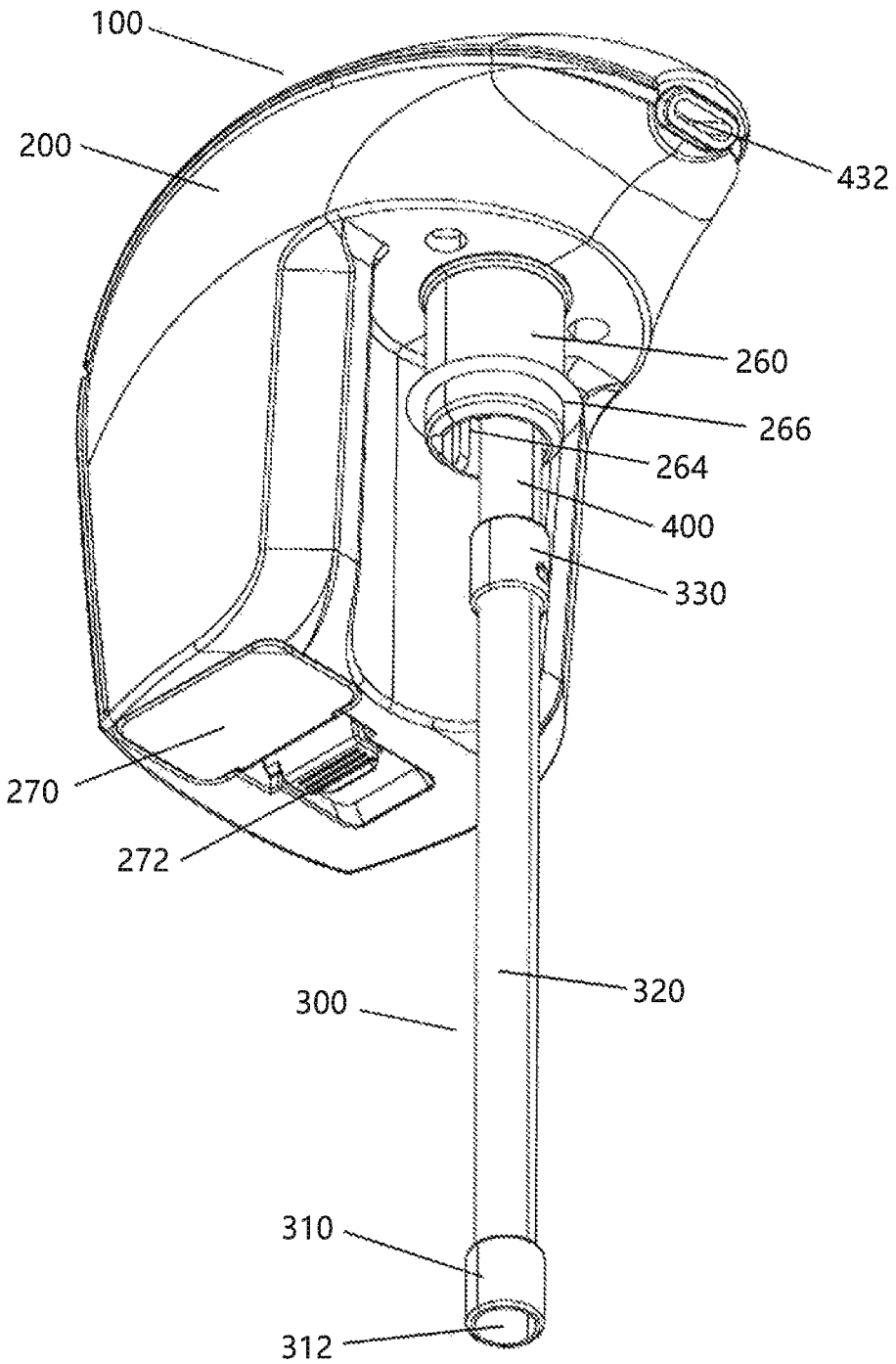
FIG. 1 is a bottom elevation view of the liquid dispenser in accordance with the present disclosure.

A more complete understanding of the articles/devices, processes and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "about" and "approximately" can be used to include any numerical value that can vary without changing the basic function of that value. When used with a range, "about" and "approximately" also disclose the range defined by the absolute values of the two endpoints, e.g., "about 2 to about 4" also discloses the range "from 2 to 4." Generally, the terms "about" and "approximately" may refer to plus or minus 10% of the indicated number.

Percentages of elements should be assumed to be percent by weight of the stated element, unless expressly stated otherwise.

Referring now to the drawings wherein the showings are for the purpose of illustrating non-limiting embodiments of the invention only and not for the purpose of limiting same, FIGS. 1-6 illustrate one non-limiting embodiment of the liquid dispenser in accordance with the present disclosure. The liquid dispenser 100 is designed to dispense fluid such as wine (not shown) from a container C such as a wine bottle into a glass, cup, or the like. The liquid dispenser 100 of the present disclosure enables a user to create a fountain-type dispenser to enable convenient dispensing of fluid from the container C without having to lift and then pour the fluid from the container. The liquid dispenser 100 is also optionally designed to aerate a fluid such as wine as the fluid is dispensed from the container C.

The liquid dispenser 100 includes a top portion 200 and a bottom portion 300. The materials and/or colors of the components of the liquid dispenser are non-limiting.

Figure 2:
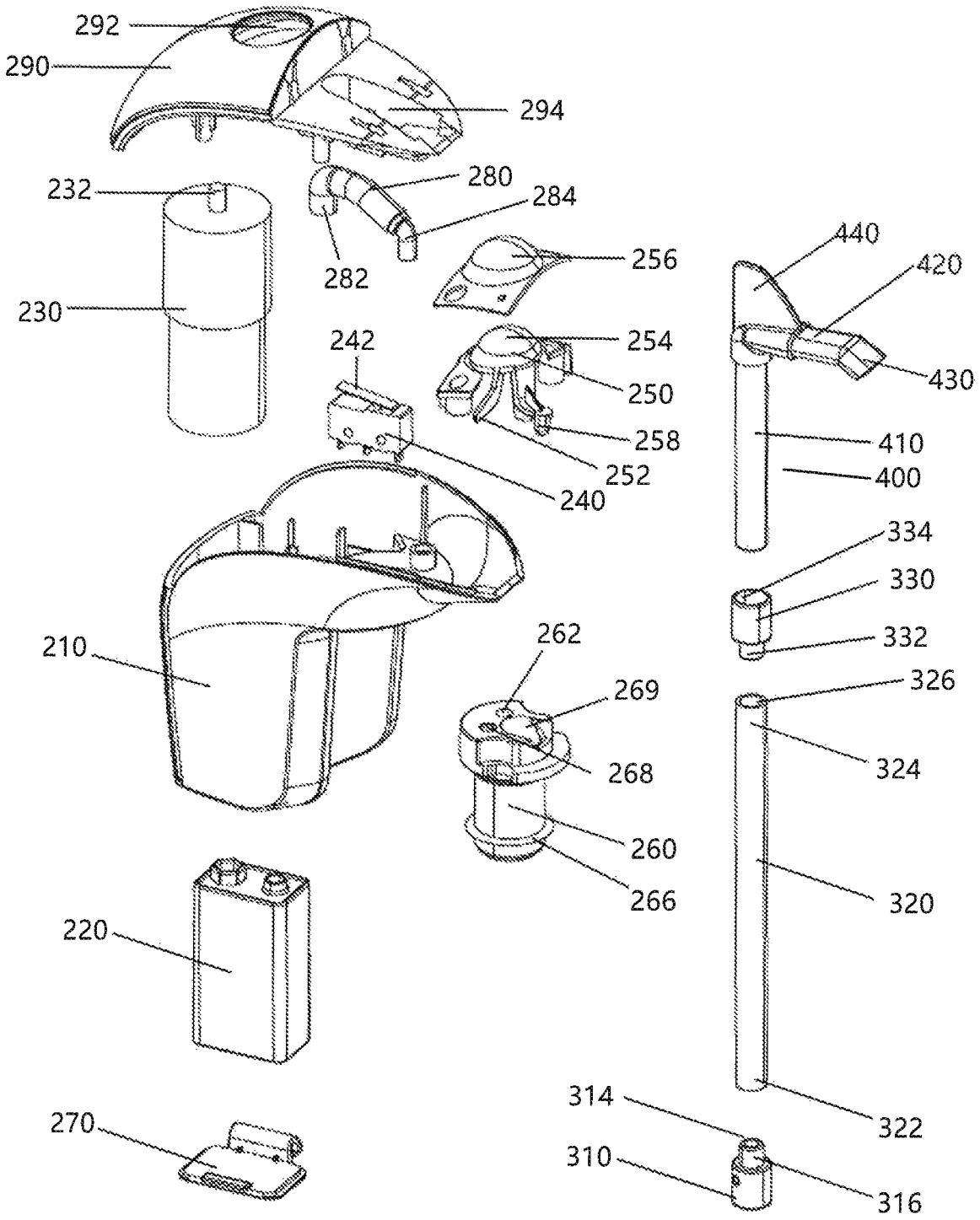
FIG. 2 is a partial exploded view of the liquid dispenser of FIG. 1.

Referring now to FIGS. 1 and 2, the bottom portion 300 is formed of multiple components; however, this is not required. The bottom portion 300 is generally formed of a plastic material; however, other or additional materials can be used to form all or a portion of the bottom portion. As best illustrated in FIG. 2, the bottom portion includes a base portion 310 that includes a bottom opening 312, a top opening 314, and an internal passageway that connects to both openings. The top section 316 of the bottom portion 310 includes a narrower section that is configured to fit into an opening in a bottom portion 322 of a lower cylindrical section 320. The lower cylindrical section 320 can optionally be formed of a flexible material. The top portion 324 of the lower cylindrical section 320 includes a top opening 326. An internal passageway connects the opening in the bottom portion 322 to the top opening 326 in the top portion 324. The bottom portion 300 can optionally include a connector 330 that is configured to fluidly connect the lower cylindrical section 320 to the dispensing portion 400. The optional connector 330 includes a top opening 334 and a lower narrower portion 332. The lower narrower portion 332 is configured to be inserted into the top opening 326 in the top portion 324 of the lower cylindrical section 320; however, it can be appreciated that the lower cylindrical section 320 can have many other shapes. The connector 330 includes a passageway that connects the top opening 334 to a bottom opening in the lower narrower portion 332.

The length of the bottom portion 300 is non-limiting. In one non-limiting design, the bottom portion 300 has a length that is the same or slightly greater than the longitudinal length of the internal cavity of the container C. The cross-sectional size and shape of the bottom portion 300 is also non-limiting. In one non-limiting design, when the bottom portion 300 has a circular cross-sectional shape, the diameter is about 0.05-0.5 in. The cross-sectional size and/or shape of the bottom portion 300 can be constant along the longitudinal length or central axis of the bottom portion; however, this is not required. One or more portions of the bottom portion 300 can be designed to be flexible and/or be formed of a flexible material; however, this is not required. The bottom portion can be irremovably connected or removably connected to the dispensing portion 400.

The dispensing portion 400 includes a lower portion 410 that is configured to form a fluid connection with the connector 330. The dispensing portion 400 includes an upper portion 420 that is connected to the lower portion 410 and a fluid connection exists between the upper portion 420 and the lower portion 410. Both the upper portion 420 and the lower portion 410 include internal passageways to allow fluid flow through the upper portion 420 and the lower portion 410. The front of the upper portion includes a downwardly angled tip portion 430 that includes an opening 432 to allow fluid to be expelled from the dispensing portion 400. The downward angle is generally about 10-50° (and all values and ranges therebetween), and typically about 30-45°. The dispensing portion 400 can optionally include an upwardly extending flange 440 that is used to support a lid of the top portion 200. The upwardly extending flange 440 can be optionally used to facilitate in maintaining the dispensing portion 400 in position when the cover 296 is connected to the upper housing portion 290. The upwardly extending flange 440 can also to alternatively optionally be used to facilitate in the removal of the dispensing portion 400.

The top portion 200 includes a lower housing section 210 that is configured to house a power source 220 (e.g., battery), an air pump 230, an activation switch 240, activation button 250, and bottom portion support 260. The shape of the top portion is non-limiting. The materials used to form the top portion is non-limiting (e.g., plastic, metal, ceramic, etc.).

Figure 3:
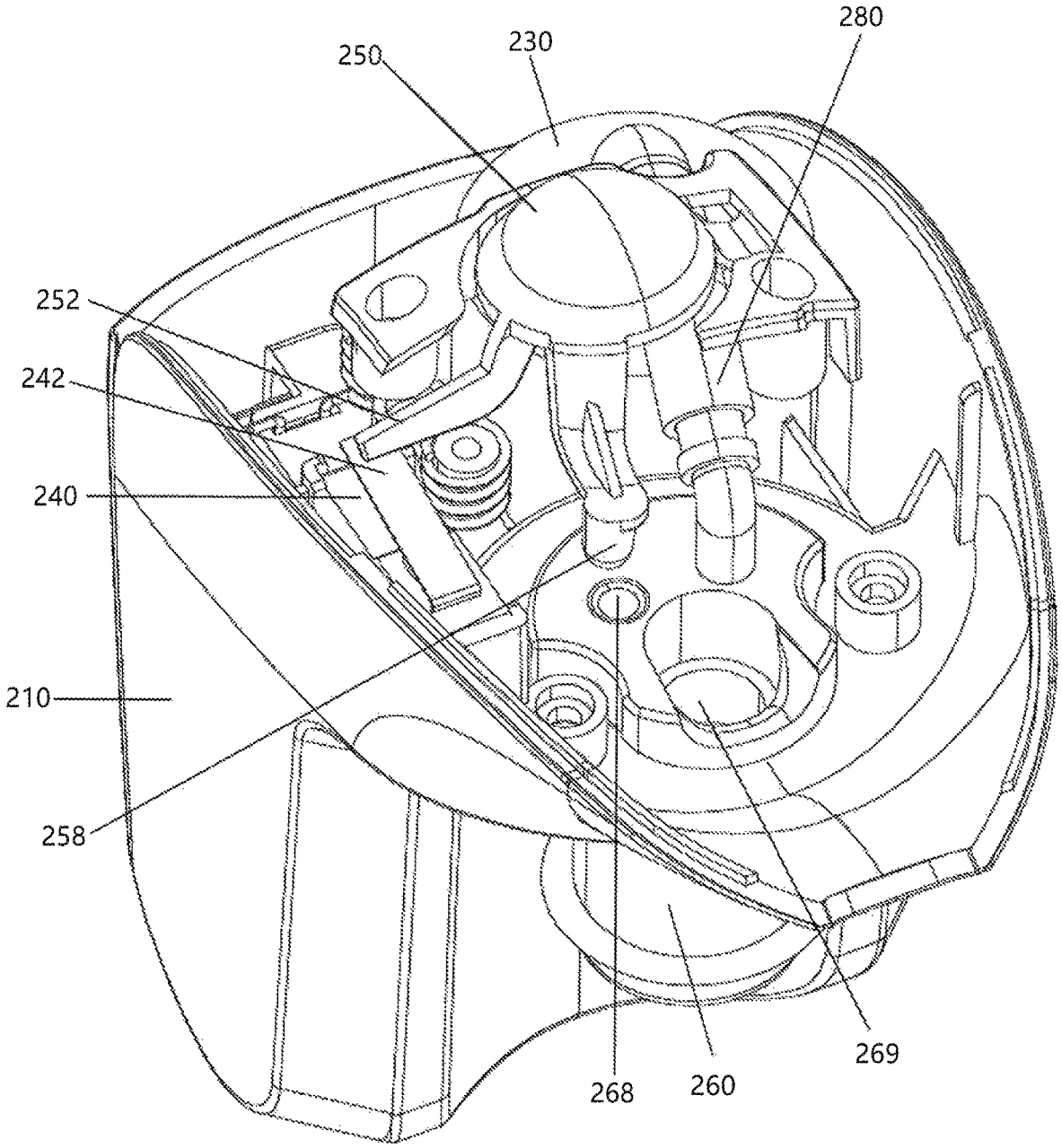
FIG. 3 is a partial top elevation view of the liquid dispenser of FIG. 1.
Figure 4:
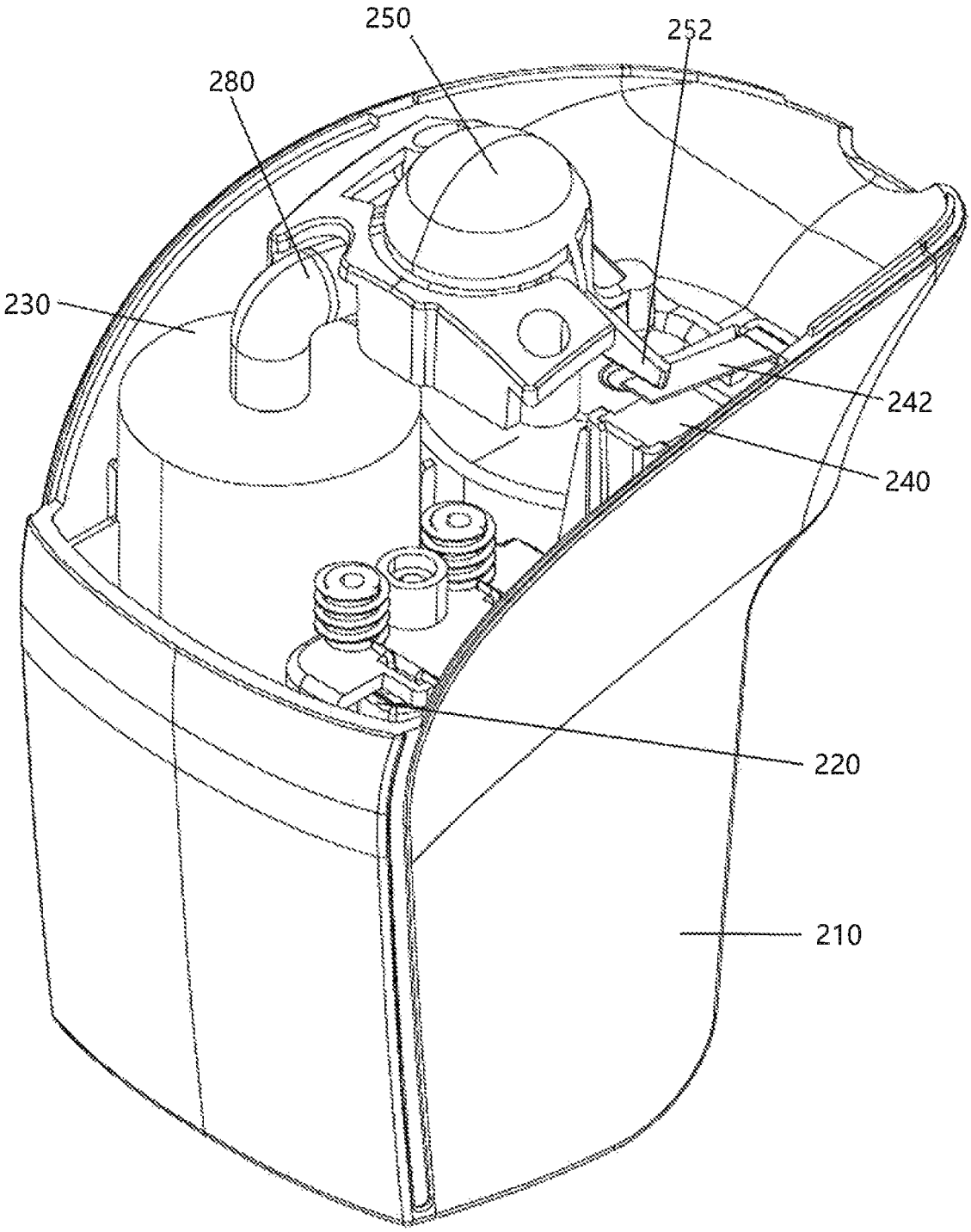
FIG. 4 is another partial top elevation view of the liquid dispenser of FIG. 1.
Figure 5:
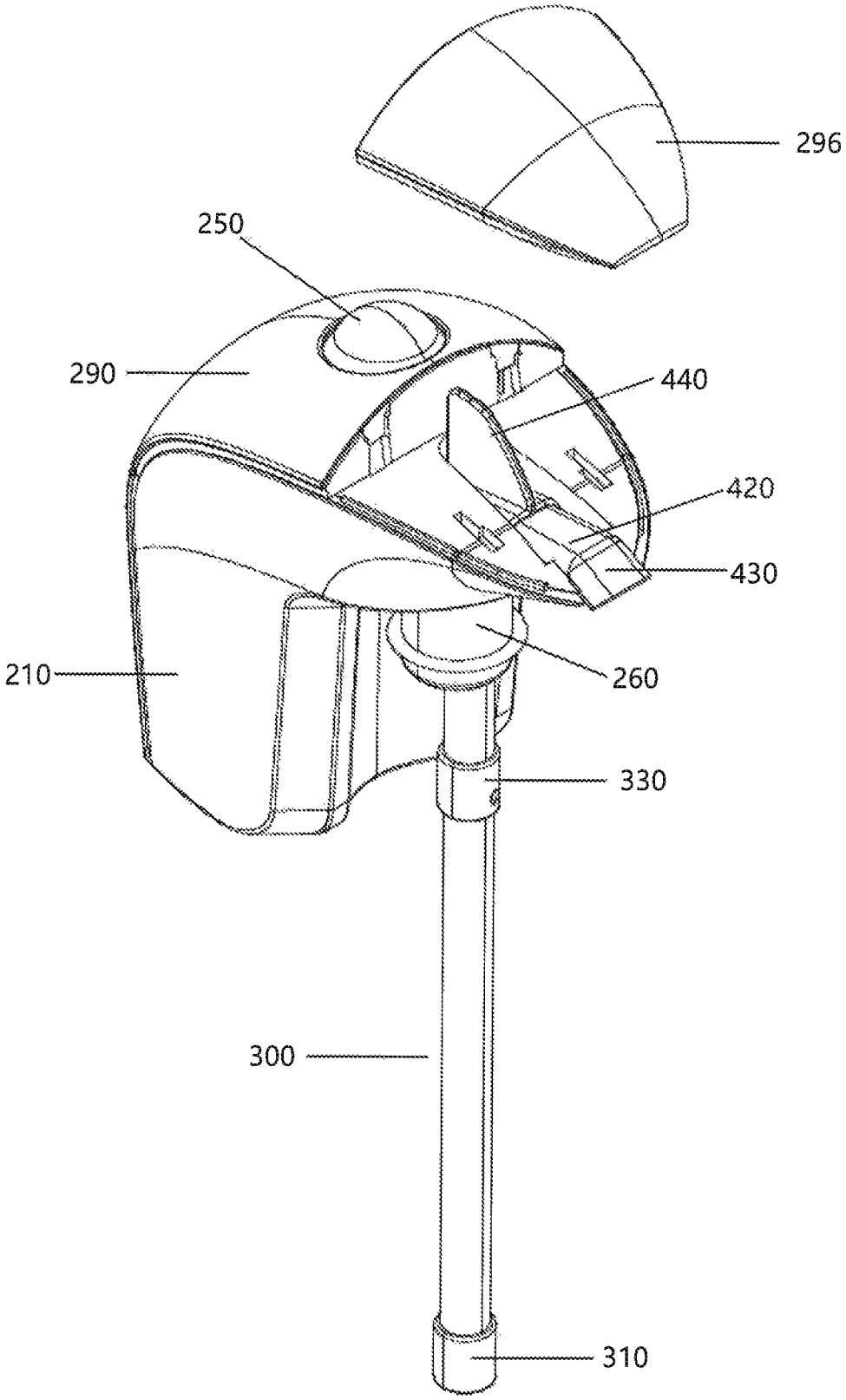
FIG. 5 is a partial exploded view of the liquid dispenser of FIG. 1.
Figure 6:
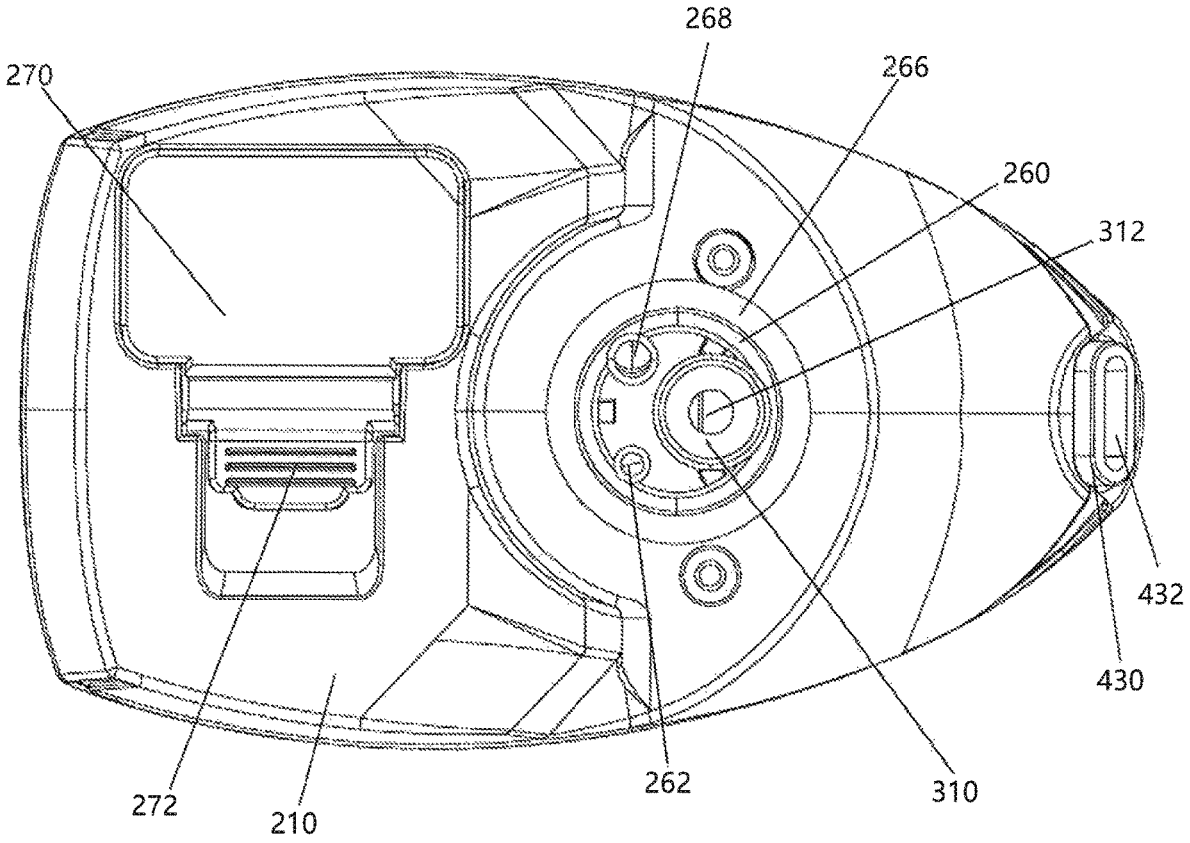
FIG. 6 is a bottom plan view of the liquid dispenser of FIG. 1.

As illustrated in FIGS. 3 and 4, the power source 220 is configured to be positioned in a rear side of the lower housing section 210; however, it can be appreciated that the power source 220 can be located in other regions of the lower housing section 210. The power source 220 can be removed and replaced in the lower housing section 210 via a battery door 270 that is located on the bottom side of the lower housing section 210; however, it can be appreciated that the battery door 270 can be located in other locations on the lower housing section 210. The battery door 270 can optionally include gripping ribs 272 to facilitate in the opening of the battery door 270.

As illustrated in FIGS. 3 and 4, the air pump 230 is configured to be positioned in a rear side of the lower housing section 210 across from the power source 220; however, it can be appreciated that the air pump 230 can be located in other regions of the lower housing section 210. The air pump 230, when energized by the power source 220, is configured to pump air into air connector 280. When the air pump is activated, the air pump draws air from the surrounding environment and into the lower housing section 210. The air pump 230 expels pressurized air out of the top opening 232 of the air pump 230 and into a first end 282 of the air connector 280. The air connector 280 includes an internal passageway which allows the air from the air pump 230 to flow through the air connector 280 and exit a second end 284 of the air connector 280.

The air exiting the second end 284 of the air connector 280 passes into a primary air opening 262 of bottom portion support 260. The pressurized air that passes into primary air opening 262 of bottom portion support 260 exits out bottom opening 264. When the liquid dispenser 100 is connected to the top of container C, the lower section of the bottom portion support 260 fits into the top opening of container C and a sealing ring 266 on bottom portion support 260 forms an air seal between the container C and the outer surface of the bottom portion support 260. As such, air from the air pump 230 can be used to pressurize the inner cavity of container C when the liquid dispenser 100 is connected to the top of container C. The sealing ring 266 is generally formed of an elastomeric material, rubber material, etc. The shape and size of the sealing ring 266 is non-limiting.

The bottom portion support 260 includes a depressurization opening 268 that connects to a passageway through the bottom portion support 260 and to bottom opening 264. The depressurization opening 268 is used to allow the inner cavity of container C to depressurize and equalize with the pressure of the ambient environment (e.g., t atm, etc.) after the air pump 230 is deactivated.

The upper section of the bottom portion support 260 is configured to be connected to a lower region of the lower housing section 210.

The bottom portion support 260 includes a central passage 269 that is configured to receive a portion of the lower portion 410 of the dispensing portion 400. The bottom portion support 260 is used to facilitate in connecting the dispensing portion 400 to the bottom portion support 260 and lower housing section 210. Generally, when the lower portion 410 of the dispensing portion 400 is connected in the central passage 269 of the bottom portion support 260, an airtight seal is formed between a portion of the outer surface of the lower portion 410 of the dispensing portion 400 and at least a portion of the inner surface of central passage 269 of bottom portion support 260. The airtight seal can be formed by a sealing ring or other type of sealing structure.

The activation switch 240 is configured to cause the air pump 230 to be activated and deactivated. The activation switch 240 includes a biased lever 242 that is biased in the inactivation mode. The biased lever can be moved from the inactivation mode to the activation mode by the depression of the activation button 250 by a user. When the user presses downwardly on the activation button 250, the biased lever 242 is caused to move downwardly, thereby causing the biased lever to move from the inactivation mode to the activation mode. When the biased lever 242 is moved to the activation mode, power from the power supply 220 is supplied to the air pump 230 to activate the air pump 230. When the activation button 250 is released by the user, the biased lever moves to the inactivation mode, thereby deactivating the air pump 230.

The activation button 250 includes a switch leg 252 that is configured to engage the biased lever 242 to cause the biased lever 242 to move from inactivation mode to the activation mode when the activation button 250 is depressed by a user.

The activation button 250 includes a top rounded section 254 that can optionally be covered by a button cover 256. As can be appreciated, the top rounded section 254 can have other shapes. The optional button cover 256 can be formed of a flexible material (e.g., elastomer, rubber, plastic, etc.). The optional button cover 256 (when used), is used to protect the activation button, create a better tactile feel when pressing the activation button 250, and/or improve the aesthetics of the liquid dispenser 100. The activation button 250 also includes an air sealing arm 258. The air sealing arm is used to seal the depressurization opening 268 of the bottom portion support 260 when the activation button 250 is depressed by a user. When the activation button 250 is pushed downwardly by the user to cause the air pump 230 to be activated, the downward movement of the activation button 250 causes the end portion of the air sealing arm 258 to enter the depressurization opening 268 to create an air seal, which air seal prevents air that is pumped into the cavity of the container C to escape via the depressurization opening 268. When the activation button 250 is released by the user, the activation button is caused to rise to its original non-depressed position, which results in the end portion of the air sealing arm 258 being removed from the depressurization opening 268 thereby allowing pressurized air in the cavity of the container C to escape from the cavity via the depressurization opening 268 and allowing the pressure in the cavity of the container C to equalize with the ambient pressure about the container. The top portion 200 also includes an upper housing portion 290 that connects to the lower housing section 210. The upper housing portion 290 includes an opening 292 for the top rounded section 254 and the optional button cover 256. The upper housing portion 290 also includes a cavity 294 for the upper portion 420 dispensing portion 400. A cover 296 is optionally used to cover a portion of the upper housing portion 290.

The liquid dispenser 100 can be designed to allow air to be mixed with the liquid (e.g., wine) prior to and/or during dispensing of the liquid from the container so as to partially or fully aerate the liquid as the liquid is being dispensed from the liquid dispenser 100; however, this is not required.

The liquid dispenser 100 can also be designed to cause fluid to back flow in the liquid dispenser 100 when the electric powered air pump 230 is deactivated. Such a design limits or prevents fluid from dripping from the liquid dispenser 100 after the electric powered air pump 230 is deactivated.

As illustrated in FIG. 2, the liquid dispenser 100 can include a specially designed upper portion 420 of the dispensing portion 400 that facilitates in the aeration of liquid such as wine from the liquid dispense 100; however, this is not required. As illustrated in FIG. 2, the lower portion 410 of the dispensing portion 400 has a generally circular cross-sectional shape for the internal passageway. The shape of the internal passageway of the dispensing portion 400 changes to an elongated oval shape, discorectangle shape, or obround shape in the upper portion 420 of the dispensing portion 400 as illustrated by the cross-sectional shape of opening 432 illustrated in FIG. 1. This change in cross-sectional shape of the internal passageway of the dispensing portion 400 has been found to improve aeration of liquids such as wine that are dispensed from the dispensing portion 400. Also, the elongated oval shape, discorectangle shape, or obround shape has been found to create a desirable fluid flow from the downwardly angled tip portion 430 as fluid is dispensed from the liquid dispenser.

In operation of the liquid dispenser 100, a user places the bottom portion 300 of the liquid dispenser into the opening of container C and also places the portion of the bottom portion support 260 and dispensing portion 400 that extends downwardly from the bottom of the lower housing section 210 into the opening of container C. The cross-sectional shape of the bottom portion support 260 is generally circular and is sized so that it can fit into an opening of a standard 750 ml wine bottle (e.g., 0.75 in. diameter opening). For example, the diameter of the circular cross-sectional shape of the bottom portion support 260 is generally about 0.65-0.725 in. so that it can fit into a 0.75 circular-shaped opening of a wine bottle. The lower housing section 210 is inserted into the opening of container C a sufficient distance so that the sealing ring 266 on bottom portion support 260 forms an air seal between the container C and the outer surface of the bottom portion support 260. As illustrated in FIG. 1, the cross-sectional size of the bottom portion 300 of the liquid dispenser is inserted into the opening of container C and also places the portion of the bottom portion support 260 and dispensing portion 400 that extends downwardly from the bottom of the lower housing section 210 into the opening of container C is generally less than the cross-sectional shape of the bottom portion support 260.

Figure 7:
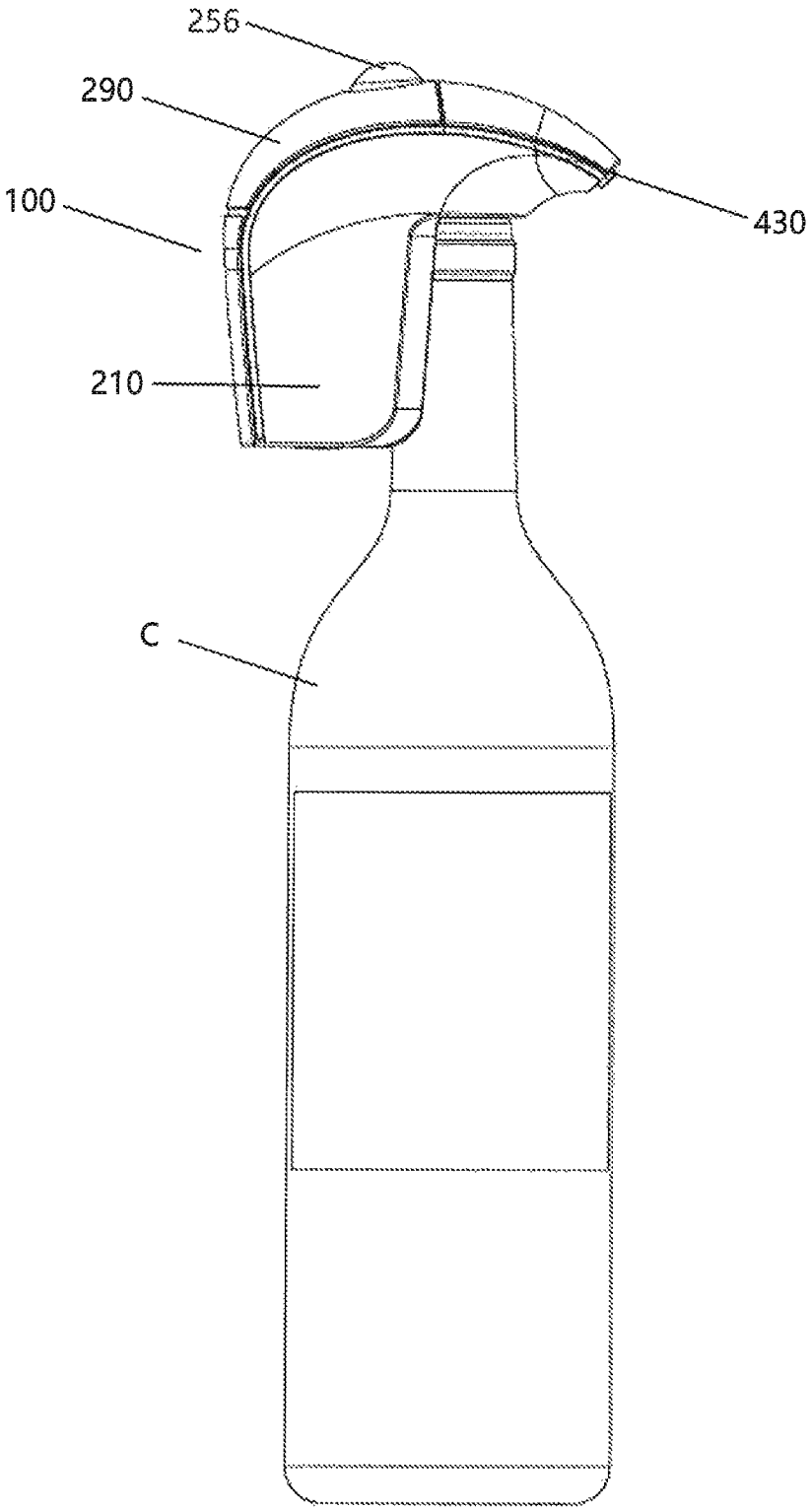
FIG. 7 illustrate the liquid dispenser of FIG. 1 connected to a wine bottle.

As illustrated in FIGS. 1 and 7, the front side surface of the lower housing section 210 is shaped so that the liquid dispenser 100 can easily be removably connected to the container C. As illustrated in FIG. 1, the front side surface of the lower housing section 210 has a curved profile that curves about a portion of the next of the container C when the liquid dispenser 100 is connected to the container C; however, it can be appreciated that the front side surface of the lower housing section 210 can have other shape profiles. As illustrated in FIG. 7, the profile of the liquid dispenser 100 when connected to the container C is a generally low profile so that the liquid dispenser 100 does not interfere with placing the container C with the liquid dispenser 100 attached onto a shelf in a refrigerator. Generally, the liquid dispenser 100 extends no more than 4 inches above the top opening of the container C when the liquid dispenser 100 is removably connected to the container C. In one non-limiting embodiment, the liquid dispenser 100 extends no more than 3 inches above the top opening of the container C when the liquid dispenser 100 is removably connected to the container C, and generally no more than 2 inches above the top opening of the container C when the liquid dispenser 100 is removable connected to the container C.

Once the liquid dispenser is removably connected to the container C, a user can simply dispense liquid from the container by activating the air pump 230 of the liquid dispenser. The air pump 230 can be activated by the user by merely pressing downwardly on button cover 256. The downward pressing of button cover 256 in turn causes activation button 250 to be moved downwardly. The downward movement of activation button 250 causes switch leg 252 on activation button 250 to engage the biased lever 242 and cause the biased lever 242 to move from an inactivation mode to the activation mode. When the biased lever 242 moves to an activation mode, power from power source 220 is allowed to energize air pump 230 and cause pressurized air to flow from the air pump 230, into air connector 280, into bottom portion support 260, and then into the cavity of container C. Also, downward movement of activation button 250 causes then end portion of air sealing arm 258 to move into the depressurization opening 268 of the bottom portion support 260 and seal the depressurization opening 268 to prevent air flow through the depressurization opening 268 when the activation button 250 has moved downwardly to cause activation of the air pump 230.

As pressurized air flows into the cavity of the container C, the pressure in the cavity of the container C increase and causes liquid in the cavity to flow into bottom opening 312 of the base portion 310 of the bottom portion 300. As the fluid flows into bottom opening 312, the fluid travels upwardly through the bottom portion 300 and into the lower portion 410 of the dispensing portion 400, into the upper portion 420 dispensing portion 400, and then ultimately dispelled from the liquid dispenser 100 via opening 432 of the dispensing portion 400.

When the user wants to terminate the dispensing of fluid from the liquid dispenser, the user merely reduces pressure on button cover 256. Activation button 250 is configured to be biased in the upward position such that when the user merely reduces pressure on button cover 256, the activation button 250 moves upwardly to its fully upward position. As the activation button 250 moves upwardly, switch leg 252 on activation button 250 also moves upwardly and causes or allows the biased lever 242 to move to the inactivation mode or position. Once the biased lever 242 has moved to the inactivation mode or position, power from the power source 220 is cutoff from the air pump 230, thereby causing the air pump to stop.

Also, the upward movement of the activation button 250 causes the end portion of air sealing arm 258 to move out of the depressurization opening 268 of the bottom portion support 260 and allows air flow through the depressurization opening 268. Since the cavity of the container C is pressurized, air in the cavity of the container is allowed to flow through the bottom portion support 260 via depressurization opening 268 to allow the pressure in the cavity to equalize with the pressure about the container (e.g., 1 atm.). The rapid equalization of pressure of the container cavity with the ambient pressure causes fluid in the dispensing portion 400 and the base portion to flow downwardly and at least partially out through bottom opening 312 and into the cavity of container C. The at least partial draining of fluid from the dispensing portion 400 reduces or eliminates dripping of fluid from the dispensing portion 400 after the operation of the air pump 230 has been terminated. Such an anti-drip feature of the liquid dispensing is a significant improvement over prior liquid dispensers.

When the liquid dispenser 100 is to be removed from the container C, the liquid dispenser 100 can be simply lifted off of the container and then cleaned, stored, and/or used on another container.

To aid the Patent Office and any readers of this application and any resulting patent in interpreting the claims appended hereto, Applicant does not intend any of the appended claims or claim elements to invoke 35 U.S.C. 112(f) unless the words "means for" or "step for" are explicitly used in the particular claim.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present disclosure. It is also to be understood that the following claims are intended to cover all of the generic and specific features of the invention herein described and all statements of the scope of the invention, which, as a matter of language, might be said to fall therebetween.

What is claimed:

1. A liquid dispenser adapted to dispense liquid from a beverage container, said liquid dispenser including a top portion, a bottom portion, an electric powered air pump; said bottom portion fluidly connected or interconnected to said top portion; said top portion configured to be releasably connected to the beverage container; said top portion including a dispenser activator system and a dispensing portion; said dispenser activator system configured to activate said electric powered air pump; said dispenser portion configured to enable fluid that flows to said top portion to exit said top portion via said dispenser portion; said electric powered air pump configured to cause gas to flow into said beverage container and to cause an increase pressure in the beverage container when said electric powered air pump is activated and said top portion is releasably connected to the beverage container, and wherein increased pressure in the beverage container causes liquid in the beverage container to flow into said bottom portion and then to said top portion; said top portion including a bottom portion support and a pressure control arrangement said bottom portion support including an airflow opening, a fluid flow opening and a depressurization opening; said air flow opening configured to receive air from said electric powered air pump when said electric powered air pump is activated; said fluid flow opening configured to receive fluid that flows from said bottom portion to said top portion; said depressurization opening configured to enable pressurized air in said beverage container to flow out of said top portion; said pressure control arrangement configured to inhibit pressurized gas in the beverage container from exiting the beverage container while said electric powered air pump is activated and said top portion is releasably connected to the beverage container; said pressure control arrangement configured to allow pressurized gas in the beverage container to flow from the beverage container through said top portion while said electric powered air pump is deactivated and said top portion is releasably connected to the beverage container; at least a portion of said pressure control arrangement configured to engage and seal said said depressurization opening when said electric air pump is activated.

2. The liquid dispenser as defined in claim 1, wherein said top portion fully contains said electric powered pump, and said dispenser activator system.

3. The liquid dispenser as defined in claim 2, wherein said dispenser activator system includes an activation button that is biased in a position that causes said electric powered air pump to be deactivated, said activation button movable between a position that causes said electric powered air pump to be deactivated and a position that causes said electric powered air pump to be activated.

4. The liquid dispenser as defined in claim 3, wherein said pressure control arrangement includes a sealing structure that is configured to engage said depressurization opening in said top portion of said liquid dispenser when said electric powered air pump is activated; said sealing structure is configured to disengage from said said depressurization opening when said electric powered air pump is deactivated; and wherein disengagement of said sealing structure from said said depressurization opening allows the pressurized gas in the beverage container to flow from the beverage container through said top portion.

5. The liquid dispenser as defined in claim 4, wherein said dispensing portion includes an upper and lower portion; said upper portion including an opening that is configured to expel fluid from said liquid dispenser; said upper and lower portions each including an internal passageway; a cross-sectional shape of said internal passageway of said lower portion is different from at least a portion of a cross-sectional shape of said upper portion; said cross-sectional shape of said internal passageway of said lower portion is different from a cross-sectional shape of said opening in said upper portion; said upper portion includes a downwardly angled tip portion that includes an opening to allow fluid to be expelled from said dispensing portion; said downward angle is about 10-50°.

6. The liquid dispenser as defined in claim 5, wherein said cross-sectional shape of said internal passageway of said lower portion is circular and said cross-sectional shape of said opening in said upper portion is selected from the group of elongated oval shape, discorectangle shape, or obround shape.

7. The liquid dispenser as defined in claim 1, wherein said dispenser activator system includes an activation button that is biased in a position that causes said electric powered air pump to be deactivated, said activation button movable between a position that causes said electric powered air pump to be deactivated and a position that causes said electric powered air pump to be activated.

8. The liquid dispenser as defined in claim 1, wherein said pressure control arrangement includes a sealing structure that is configured to engage said depressurization opening in said top portion of said liquid dispenser when said electric powered air pump is activated; said sealing structure is configured to disengage from said said depressurization opening when said electric powered air pump is deactivated; and wherein disengagement of said sealing structure from said said depressurization opening allows the pressurized gas in the beverage container to flow from the beverage container through said top portion.

9. The liquid dispenser as defined in claim 1, wherein said dispensing portion includes an upper and lower portion; said upper portion including an opening that is configured to expel fluid from said liquid dispenser; said upper and lower portions each including an internal passageway; a cross-sectional shape of said internal passageway of said lower portion is different from at least a portion of a cross-sectional shape of said upper portion; said cross-sectional shape of said internal passageway of said lower portion is different from a cross-sectional shape of said opening in said upper portion; said upper portion includes a downwardly angled tip portion that includes an opening to allow fluid to be expelled from said dispensing portion; said downward angle is about 10-50°.

10. The liquid dispenser as defined in claim 9, wherein said cross-sectional shape of said internal passageway of said lower portion is circular and said cross-sectional shape of said opening in said upper portion is selected from the group of elongated oval shape, discorectangle shape, or obround shape.

11. A method for converting a beverage container into a beverage container having an electric dispenser comprising:

a. providing a liquid dispenser adapted to dispense liquid from the beverage container; said liquid dispenser including a top portion, a bottom portion, an electric powered air pump; said bottom portion fluidly connected or interconnected to said top portion; said top portion configured to be releasably connected to the beverage container; said top portion including a dispenser activator system and a dispensing portion; said dispenser activator system configured to activate said electric powered air pump; said dispenser portion configured to enable fluid that flows to said top portion to exit said top portion via said dispenser portion; said electric powered air pump configured to cause gas to flow into said beverage container and to cause an increase pressure in the beverage container when said electric powered air pump is activated and said top portion is releasably connected to the beverage container, and wherein increased pressure in the beverage container causes liquid in the beverage container to flow into said bottom portion and then to said top portion; said top portion including a bottom portion support and a pressure control arrangement said bottom portion support including an airflow opening, a fluid flow opening and a depressurization opening; said air flow opening configured to receive air from said electric powered air pump when said electric powered air pump is activated; said fluid flow opening configured to receive fluid that flows from said bottom portion to said top portion; said depressurization opening configured to enable pressurized air in said beverage container to flow out of said top portion; said pressure control arrangement configured to inhibit pressurized gas in the beverage container from exiting the beverage container while said electric powered air pump is activated and said top portion is releasably connected to the beverage container; said pressure control arrangement configured to allow pressurized gas in the beverage container to flow from the beverage container through said top portion while said electric powered air pump is deactivated and said top portion is releasably connected to the beverage container; at least a portion of said pressure control arrangement configured to engage and seal said said depressurization opening when said electric air pump is activated;

b. releasably connecting said top portion to the beverage container; and, c. actuating said dispenser activator to activate said electric powered air pump to cause pressurized air to flow into said beverage container and to cause liquid in the beverage container to flow from a cavity of the container to thereby cause fluid in the container to flow into and out from said top portion of liquid dispenser.

12. The method as defined in claim 11, further including the step of inhibiting liquid from dripping from said dispensing portion after said electric powered air pump has been deactivated by causing liquid to be drawn at least partially back into a portion of said dispensing portion by rapid depressurization of the beverage container.

13. The method as defined in claim 12, wherein said top portion fully contains said electric powered pump, and said dispenser activator system.

14. The method as defined in claim 13, wherein said dispenser activator system includes an activation button that is biased in a position that causes said electric powered air pump to be deactivated, said activation button movable between a position that causes said electric powered air pump to be deactivated and a position that causes said electric powered air pump to be activated.

15. The method as defined in claim 14, wherein said pressure control arrangement includes a sealing structure that is configured to engage said depressurization opening in said top portion of said liquid dispenser when said electric powered air pump is activated said sealing structure is configured to disengage from said said depressurization opening when said electric powered air pump is deactivated; and wherein disengagement of said sealing structure from said said depressurization opening allows the pressurized gas in the beverage container to flow from the beverage container through said top portion.

16. The method as defined in claim 15, wherein said dispensing portion includes an upper and lower portion; said upper portion including an opening that is configured to expel fluid from said liquid dispenser; said upper and lower portions each including an internal passageway; a cross-sectional shape of said internal passageway of said lower portion is different from at least a portion of a cross-sectional shape of said upper portion; said cross-sectional shape of said internal passageway of said lower portion is different from a cross-sectional shape of said opening in said upper portion; said upper portion includes a downwardly angled tip portion that includes an opening to allow fluid to be expelled from said dispensing portion; said downward angle is about 10-50°.

17. The method as defined in claim 16, wherein said cross-sectional shape of said internal passageway of said lower portion is circular and said cross-sectional shape of said opening in said upper portion is selected from the group of elongated oval shape, discorectangle shape, or obround shape.

18. The method as defined in claim 11, wherein said top portion fully contains said electric powered pump, and said dispenser activator system.

19. The method as defined in claim 11, wherein said dispenser activator system includes an activation button that is biased in a position that causes said electric powered air pump to be deactivated, said activation button movable between a position that causes said electric powered air pump to be deactivated and a position that causes said electric powered air pump to be activated.

20. The method as defined in claim 11, wherein said pressure control arrangement includes a sealing structure that is configured to engage said depressurization opening in said top portion of said liquid dispenser when said electric powered air pump is activated said sealing structure is configured to disengage from said said depressurization opening when said electric powered air pump is deactivated; and wherein disengagement of said sealing structure from said said depressurization opening allows the pressurized gas in the beverage container to flow from the beverage container through said top portion.

21. The method as defined in claim 11, wherein said dispensing portion includes an upper and lower portion; said upper portion including an opening that is configured to expel fluid from said liquid dispenser; said upper and lower portions each including an internal passageway; a cross-sectional shape of said internal passageway of said lower portion is different from at least a portion of a cross-sectional shape of said upper portion; said cross-sectional shape of said internal passageway of said lower portion is different from a cross-sectional shape of said opening in said upper portion; said upper portion includes a downwardly angled tip portion that includes an opening to allow fluid to be expelled from said dispensing portion; said downward angle is about 10-50°.

22. The method as defined in claim 21, wherein said cross-sectional shape of said internal passageway of said lower portion is circular and said cross-sectional shape of said opening in said upper portion is selected from the group of elongated oval shape, discorectangle shape, or obround shape.

* * * * *